US009095755B1

(12) United States Patent
Hill

(10) Patent No.: US 9,095,755 B1
(45) Date of Patent: Aug. 4, 2015

(54) BASKETBALL TRAINING DEVICE

(71) Applicant: Curt J. Hill, Warba, MN (US)

(72) Inventor: Curt J. Hill, Warba, MN (US)

( * ) Notice: Subject to any disclaimer, the term of this patent is extended or adjusted under 35 U.S.C. 154(b) by 122 days.

(21) Appl. No.: 14/042,838

(22) Filed: Oct. 1, 2013

(51) Int. Cl.
*A63B 69/00* (2006.01)

(52) U.S. Cl.
CPC ..... *A63B 69/0071* (2013.01)

(58) Field of Classification Search
CPC .. A63B 69/0071; A63B 69/002; A63B 69/34; A63B 69/0059
USPC ..... 473/447, 422, 433, 434, 446, 448, 441, 473/445; D21/781
See application file for complete search history.

(56) References Cited

U.S. PATENT DOCUMENTS

| | | | | | |
|---|---|---|---|---|---|
| 3,552,749 | A | * | 1/1971 | Piggotte | 473/448 |
| 3,675,921 | A | * | 7/1972 | Meyers, Sr. | 473/448 |
| 4,286,779 | A | * | 9/1981 | Collins | 273/402 |
| 4,989,862 | A | * | 2/1991 | Curtis | 473/448 |
| D321,370 | S | * | 11/1991 | Curtis | D19/62 |
| 5,224,699 | A | * | 7/1993 | Zaruba | 273/375 |
| D344,558 | S | * | 2/1994 | Livera et al. | D21/701 |
| 5,413,328 | A | * | 5/1995 | Glancey et al. | 473/439 |
| 5,485,993 | A | * | 1/1996 | Lipsett | 473/448 |
| 5,527,185 | A | * | 6/1996 | Davis | 473/438 |
| 5,665,016 | A | * | 9/1997 | Burnett | 473/448 |
| 5,800,290 | A | * | 9/1998 | Barry | 473/438 |
| 5,816,951 | A | * | 10/1998 | Hudock | 473/447 |
| 5,890,985 | A | * | 4/1999 | Jenney | 473/447 |
| 6,402,153 | B1 | * | 6/2002 | Stewart | 473/415 |
| 6,733,403 | B2 | * | 5/2004 | Courtright | 473/433 |
| D539,373 | S | * | 3/2007 | Cook | D21/781 |
| 8,152,660 | B1 | * | 4/2012 | Jimenez et al. | 473/450 |
| 8,197,362 | B1 | * | 6/2012 | Johnson | 473/447 |
| 8,277,340 | B1 | | 10/2012 | Devine | |
| 8,721,476 | B2 | * | 5/2014 | Mayers | 473/447 |
| 2003/0211906 | A1 | * | 11/2003 | Seltzer et al. | 473/450 |
| 2005/0113192 | A1 | * | 5/2005 | Seaman | 473/447 |
| 2007/0225089 | A1 | * | 9/2007 | Jones | 473/447 |
| 2009/0149281 | A1 | * | 6/2009 | Johnson | 473/447 |

* cited by examiner

*Primary Examiner* — Mitra Aryanpour
(74) *Attorney, Agent, or Firm* — Dennis L. Thomte; Thomte Patent Law Office LLC

(57) ABSTRACT

A basketball training device for use with a basketball goal including a backboard having a horizontally disposed rim secured thereto. The training device includes a horizontally disposed circular support positioned below the rim which is either secured to the backboard or the rim. A horizontally disposed mounting structure is selectively horizontally rotatably mounted on the circular support. A vertically disposed simulated basketball player is secured to the mounting structure which extends downwardly therefrom. The simulated basketball player has a pair of arms secured thereto which may be moved upwardly or downwardly.

19 Claims, 10 Drawing Sheets

BASKETBALL TRAINING DEVICE

BACKGROUND OF THE INVENTION

1. Field of the Invention

This invention relates to a basketball training device and more particularly to a basketball training device including a simulated basketball player which is movably secured to the back board or rim of a basketball goal.

2. Description of the Related Art

The game of basketball requires a player to possess dribbling, shooting and rebounding skills. To acquire those skills, it is necessary for the player to practice dribbling, shooting and rebounding. It is important that the player be able to dribble, shoot and rebound around or over a defensive player. Thus, the player seeking to improve his/her basketball skills must find a player who is willing to defend the player during the practice sessions.

In an attempt to provide a basketball training device, U.S. Pat. No. 8,277,340 discloses a training device which mimics an opposing player during practice. The device of the '340 patent must be manually moved from one position to another. The arms of the device shown in the '340 patent are fixed and are not selectively movable.

Another attempt at providing a realistic basketball training device is shown in the Sep. 1, 2013 article published by TV Atlanta Journal-Constitution. In that article, a robot shot blocker called BlockoMan is described. The arms of the BlockoMan are movable but are believed to be comprised of a rigid material. Since BlockoMan is not movably attached to the backboard or rim of a basketball goal, the device is not believed to be a device which assists in rebound training.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A basketball training device is disclosed for use with a basketball goal including a backboard having a horizontally disposed rim secured thereto. The device of this invention includes a horizontally disposed circular support which is positioned below the rim and which is operatively secured to either the backboard or the rim. A horizontally disposed mounting structure is selectively rotatably secured to the circular support. A vertically disposed simulated basketball player is secured to the mounting structure which extends downwardly therefrom.

A simulated basketball player has a pair of selectively movable arms which are pivoted with respect to the body of the simulated basketball player by means of motors. The arms may also be pivotally moved manually. The mounting structure includes a motor configured to rotate the mounting structure with respect to the circular support and the rim. In the preferred embodiment, the motor is remotely controlled. In some cases, the mounting structure is manually horizontally moved relative to the rim.

It is a principal object of the invention to provide an improved basketball training device.

A further object of the invention is to provide a basketball training device which includes a simulated basketball player which is operatively movably mounted on either the rim or backboard of a basketball goal.

A further object of the invention is to provide a basketball training device of the type described which is remotely controllable.

A further object of the invention is to provide a basketball training device of the type described which assists in practice sessions relating to dribbling, shooting and rebounding skills.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
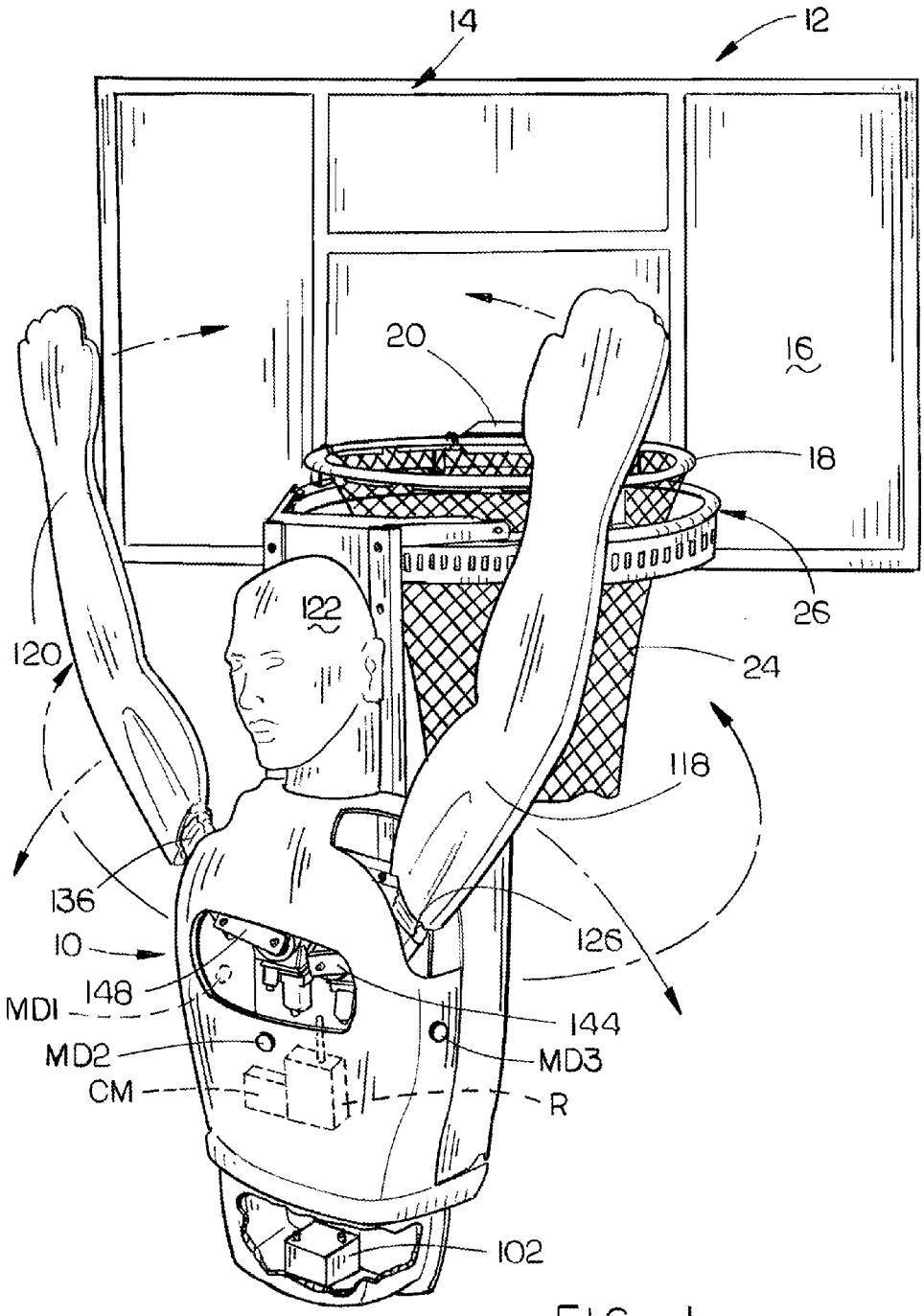
FIG. 1 is a perspective view illustrating the basketball training device of this invention which is movably movable with respect to a basketball goal.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the basketball training device of this invention which is designed to be used in conjunction with a conventional basketball goal 12 which includes a backboard 14 having a front side 16 and a back side. Goal 12 also includes a circular rim or hoop 18, having a support 20, which is secured to the front side 16 of backboard 14 by a plurality of bolts 22. Rim 18 has a net 24 secured thereto in conventional fashion.

Figure 3:
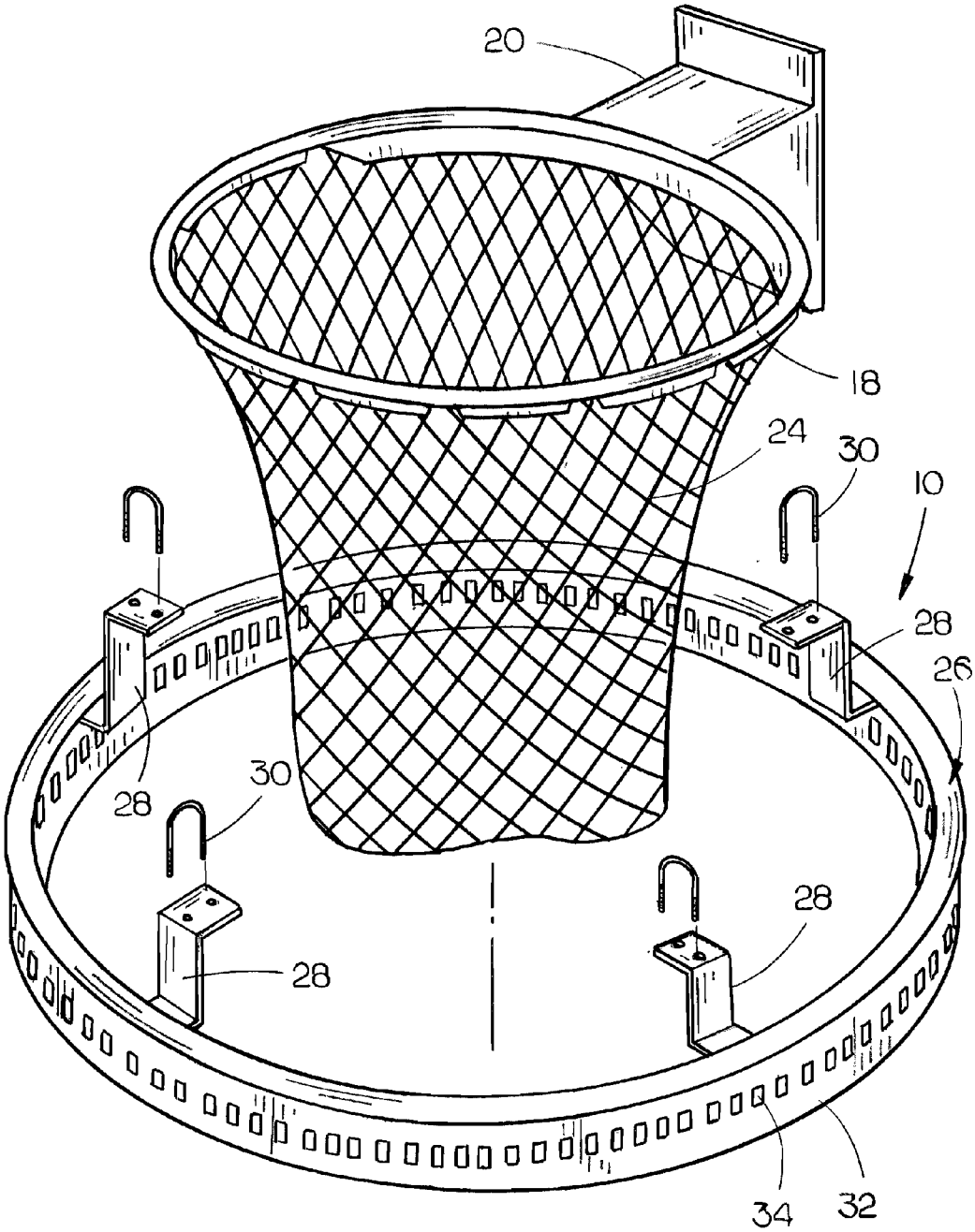
FIG. 3 is a partial exploded perspective view of the basketball training device of this invention.

Device 10 includes a circular support 26 which has a larger diameter than rim 18 and which is positioned below rim 18 as seen in FIG. 1. A plurality of spaced-apart brackets 28 have their lower ends secured to circular support 26 and have their upper ends selectively secured to rim 18 by U-bolts 30. The numeral 32 refers to a circular rack which is welded or otherwise secured to support 26 and which extends downwardly therefrom. Rack 32 has a plurality of spaced-apart gear teeth openings 34 formed therein. Although FIG. 3 illustrates that the gear teeth openings 34 extend completely around the length of rack 32, it is not necessary to provide the openings 34 at the very rearward end of rack 32 as will be explained hereinafter.

Although circular support 26 and rack 32 are shown to be separate components welded together, support 26 and rack 32 could be of single-piece construction such as a square or rectangular tube.

Figure 4:
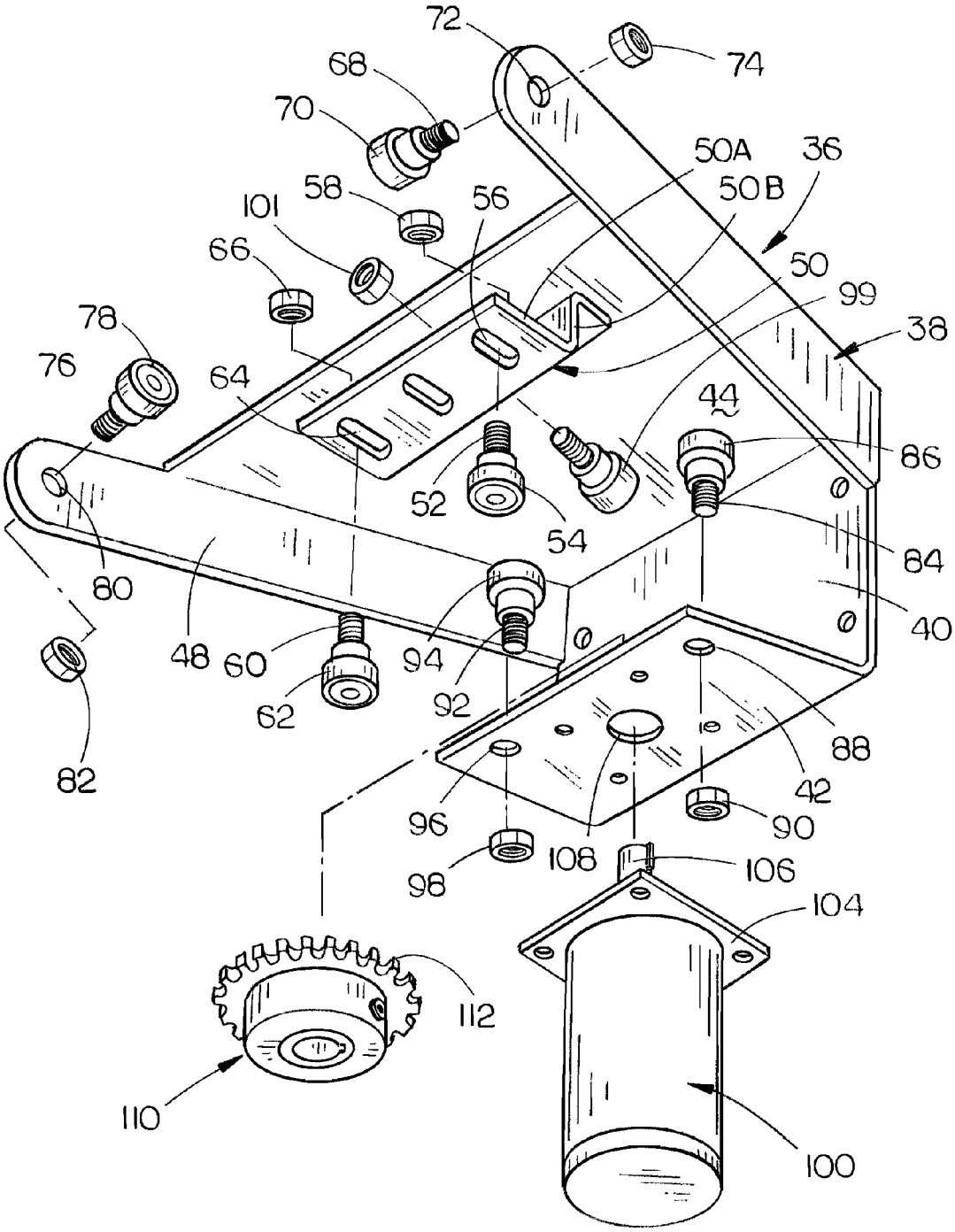
FIG. 4 is an exploded perspective view of the means for rotatably moving the simulated basketball player with respect to the backboard or rim of a basketball goal.

The numeral 36 refers to a mounting structure which is horizontally rotatably mounted on circular support 26. Mounting structure 36 includes a support frame 38 which includes a vertically disposed outer wall member 40, a lower wall member 42 which extends horizontally inwardly from the lower end of wall member 40, a top wall member 44 which extends inwardly from the upper end of wall member 40, a first side wall member 46 which extends downwardly from one side of top wall member 44 and a second side wall member 48 which extends downwardly from the outer side of top wall member 44. As seen in FIG. 4, the outer ends of wall members 46 and 48 are joined or connected to outer wall member 40. As also seen in FIG. 4, the inner ends of side wall members 46 and 48 are positioned inwardly of the inner end of top wall member 44.

An angle bracket 50 is secured to the underside of top wall member 44 by any convenient means such as welding or the like. Angle bracket 50 includes a horizontally disposed portion 50A and a vertically disposed portion 50B. The shaft 52 of a roller 54 extends through slot 56 formed in horizontally disposed portion 50A of angle bracket 50 and is secured therein by nut 58. The shaft 60 of a roller 62 extends through slot 64 formed in horizontally disposed portion 50B of angle bracket 50 and is secured therein by nut 66. The shaft 68 of a roller 70 extends through opening 72 in the inner end of side wall member 46 and is held therein by nut 74. The shaft 76 of a roller 78 extends through opening 80 in the inner end of side wall member 48 and is held therein by nut 82.

The shaft 84 of roller 86 extends downwardly through opening 88 formed in lower wall member 42 and is held therein by nut 90. The shaft 92 of roller 94 extends downwardly through opening 96 formed in lower wall member 42 and is held therein by nut 98. The shaft of a roller 99 extends through an opening in vertically disposed portion 50B of angle bracket 50 and is held therein by a nut 101. Thus, rollers 70, 78 and 99 are rotatable about a horizontal axis while rollers 54, 62, 86 and 94 are rotatable about a vertical axis.

The numeral 100 refers to a remotely controlled 12-volt electric reversible motor driven by a DC battery 102. The mounting flange 104 of motor 100 is bolted to the lower wall member 42 so that the power or drive shaft 106 of motor 100 extends upwardly through opening 108 in lower wall member 42 as indicated in FIG. 4. Drive sprocket 110 is secured to the upper end of drive shaft 106 above lower wall member 42. Sprocket 110 has a plurality of teeth 112 provided thereon which are configured to be received in the openings 34 in rack 32 as will be explained hereinafter. Motor 100 is electronically controlled by a control means CM which includes an RF receiver R.

Figure 5:
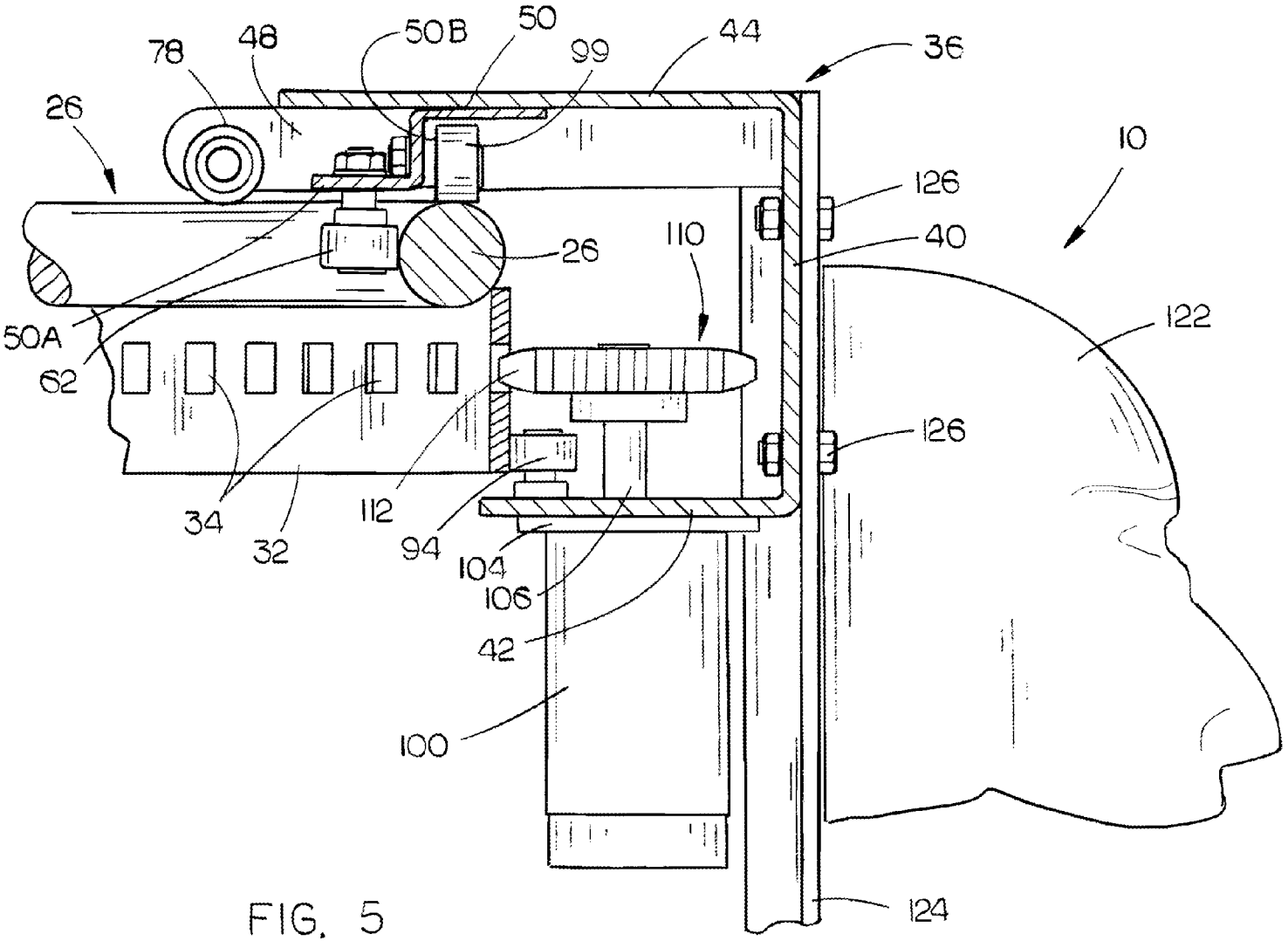
FIG. 5 is a partial sectional view illustrating the manner in which an electric motor rotates the simulated basketball player relative to the rim of a basketball goal.
Figure 6:
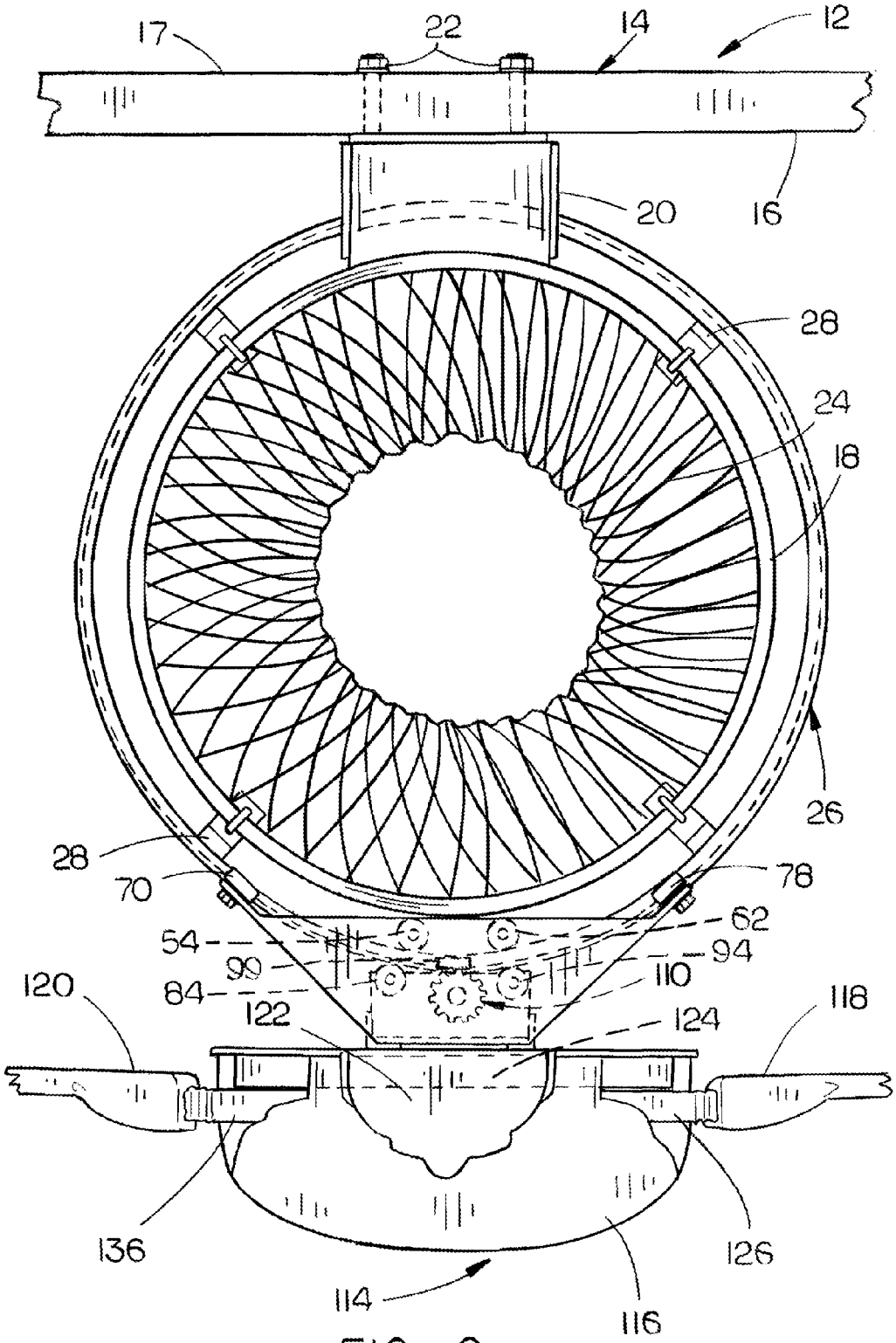
FIG. 6 is a top elevational view of the basketball training device of this invention secured to the rim of a basketball goal.
Figure 7:
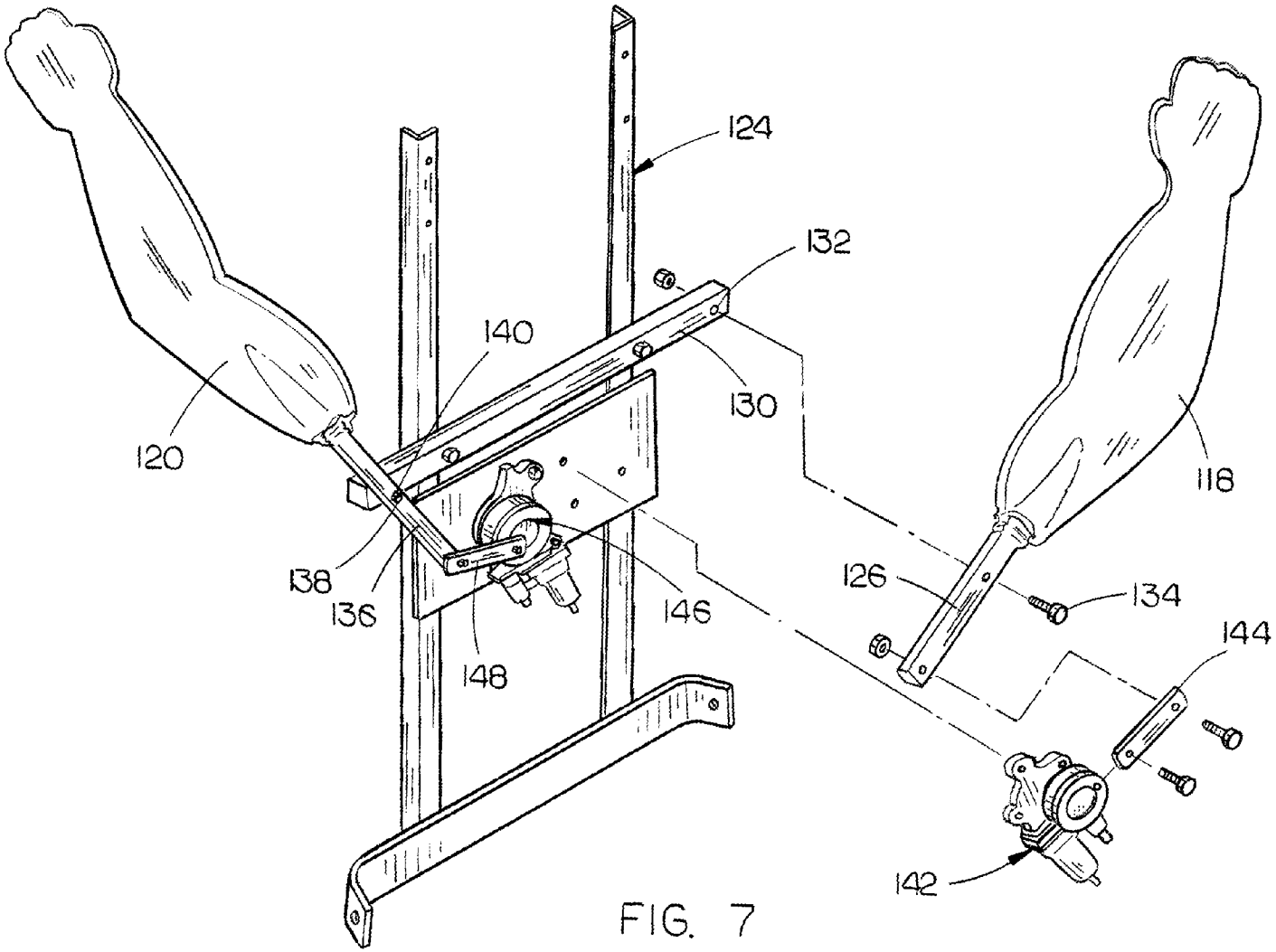
FIG. 7 is a partial exploded perspective view illustrating the means for pivotally moving the arms of the simulated basketball player.

Mounting structure 36 is mounted on the circular support 26 and circular rack 32 as partially shown in FIG. 5. When positioned on circular support 26 and circular rack 32, rollers 54 and 62 engage the inner side of circular support 26, the rollers 70, 78 and 99 engage the upper side of circular support 26, and rollers 86 and 94 engage the outer surface of rack 32 below the openings 34. When mounting structure 36 is mounted on circular support 26 and rack 32 as illustrated in FIG. 5, some of the teeth 112 of sprocket 110 are received in some of the openings 34. Thus, when drive shaft 106 is rotated in one direction, the mounting structure 36 will be rotatably moved with respect to circular support 26 and rack 32 in one direction and will be moved in an opposite direction when the drive shaft 106 is rotated in an opposite direction.

The numeral 114 refers to a simulated basketball player, robot or mannequin which is operatively connected to the mounting structure 36 for movement therewith. The simulated player 114 is shown in the drawings to be from the waist up but preferably the simulated player 114 will have a full body with legs, etc. Preferably, the simulated basketball player 114 will include a hollow body portion 116 having arms 118 and 120, and a head 122. Normally, the body portion 116 will be covered by a basketball jersey. A support frame 124 has its upper end secured to outer wall member 40 by bolts. The lower end of support frame 122 is secured to the simulated basketball player 114 so that rotational movement of support frame 124 causes the simulated player 114 to be rotated therewith. Arms 118 and 120 are preferably constructed of a soft, padded material. Preferably, an elongated flexible rubber or plastic strap 126 has one end thereof secured to the inner end of arm 118. Strap 126 is pivotally secured, intermediate its length, to one end of a frame member or bar 130, which forms a part of support frame 124, at 132, by pivot pin 134.

Preferably, an elongated flexible rubber or plastic strap 136 has one end thereof secured to the inner end of arm 120. Strap 136 is pivotally secured, intermediate its length, to the outer end of frame member 130, at 138, by pivot pin 140.

Straps 126 and 136 have sufficient rigidity to maintain arms 118 and 120 in an extended position but have sufficient flexibility to permit the arms 118 and 120 to deflect somewhat should a practicing player come into contact therewith.

A remotely controlled battery operated and reversible motor 142 is mounted on support frame 124 and is connected to strap 126 by a link 114 for pivotally moving arm 118 between its raised and lowered positions. A remotely controlled battery operated and reversible motor 146 is mounted on support frame 124 and is connected to strap 136 by a link 148 for pivotally moving arm 120 between its raised and lowered positions. Motors 142 and 146 are controlled by transmitter 150. Motor 100 is also controlled by the transmitter 150.

Although it is preferred that the simulated basketball player 114 is moved on the circular support by the electric motor 100, the simulated basketball player 114 could be manually rotated with respect to the rim 18. Further, although it is preferred that the arms 118 and 120 of the simulated basketball player are moved by electric motors, the arms could also be manually moved.

Figure 8:
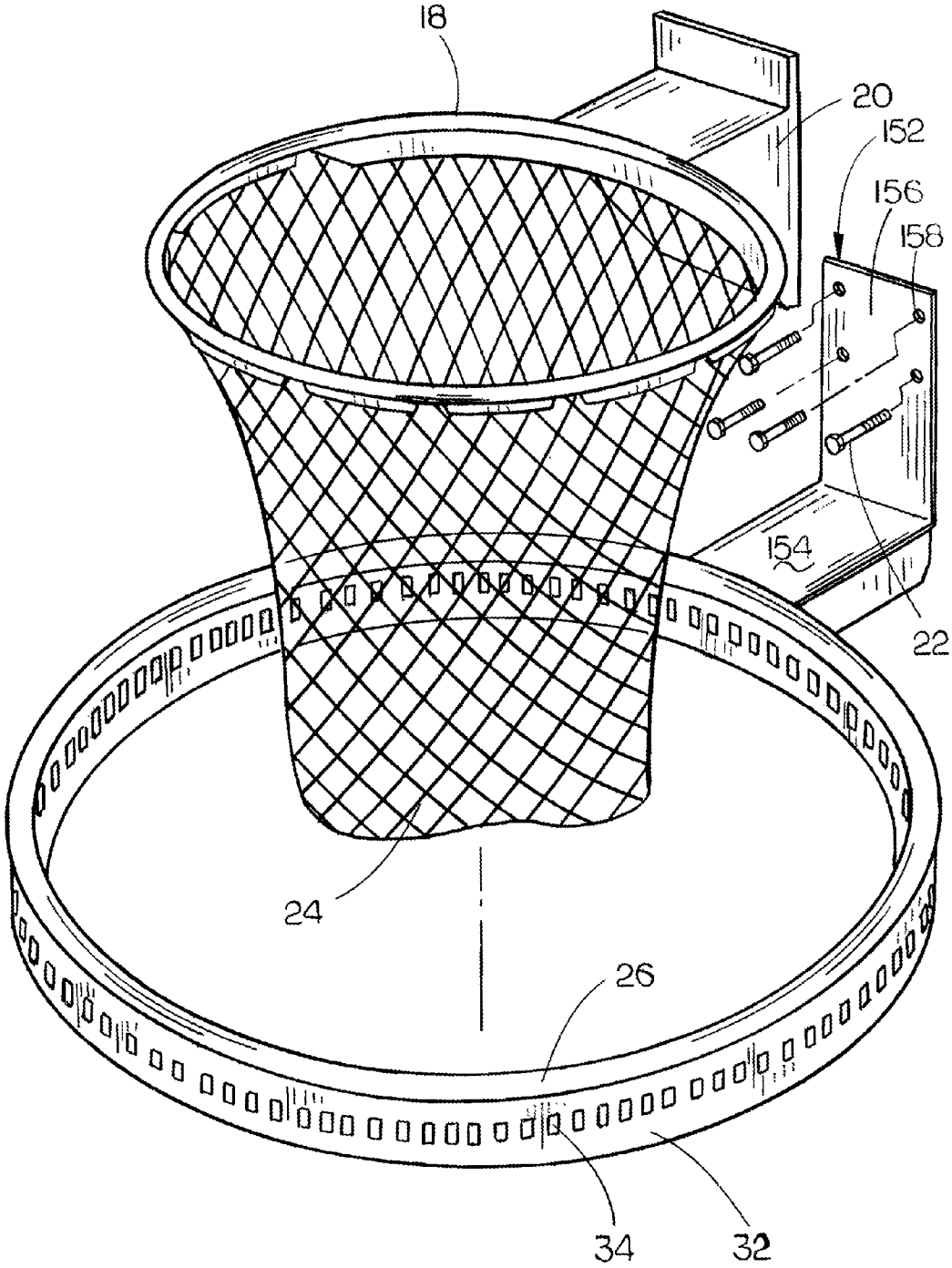
FIG. 8 is a partial perspective view illustrating the mounting structure of the training device which is secured to the backboard of a basketball goal.
Figure 9:
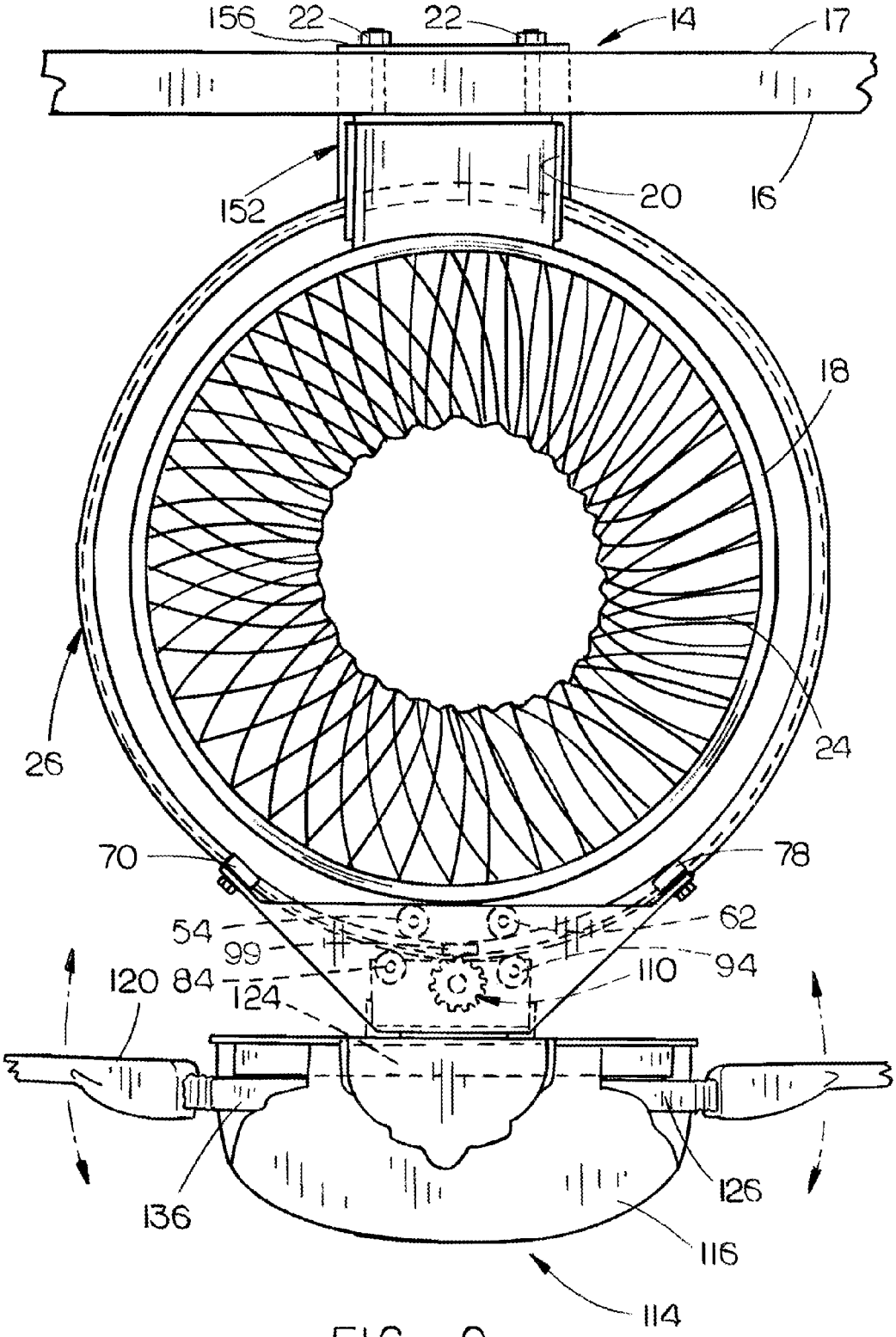
FIG. 9 is a top elevational view of the embodiment of FIG. 8.
Figure 10:
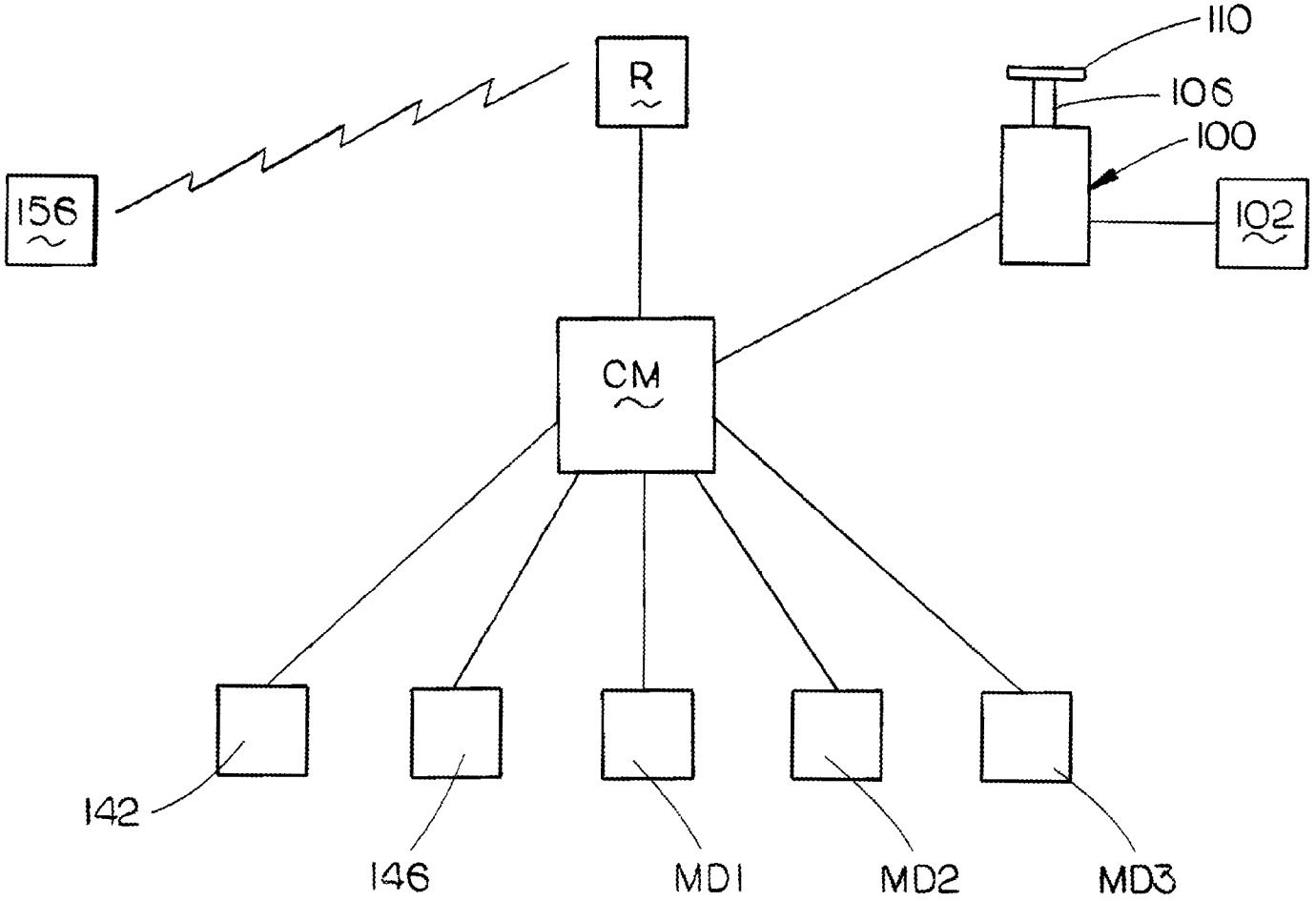
FIG. 10 is a schematic of the electrical circuit of the invention.

FIGS. 8 and 9 illustrate a different way of supporting the circular support 26. In FIGS. 8 and 9, the circular support 26 is not secured to the rim 18 by brackets 28 and U-bolts 30. In FIGS. 8 and 9, the numeral 152 refers to a support having a horizontally disposed portion 154 and a vertically disposed portion 156. The outer end of portion 154 of support 152 is secured to circular support 26 by any convenient means such as welding. The vertically disposed portion 156 of support 152 is positioned at the backside of backboard 14 and is secured thereto by the bolts 22 which extend through the back wall of support 20, through the backboard 14 and through the bolt openings 158 in vertically disposed portion 156 of support 152.

Preferably, the simulated player 114 will include three conventional motion detectors or sensors MD1, MD2 and MD3. Motion detector MD1 is mounted on the right side of the simulated player 114 and motion detector MD3 is mounted on the left side of the simulated player 114. Motion detector MD2 is mounted on the center front of the simulated player 114. Motion detectors MD1, MD2 and MD3 are electrically connected to control means CM which is electrically connected to motor 100.

Figure 2:
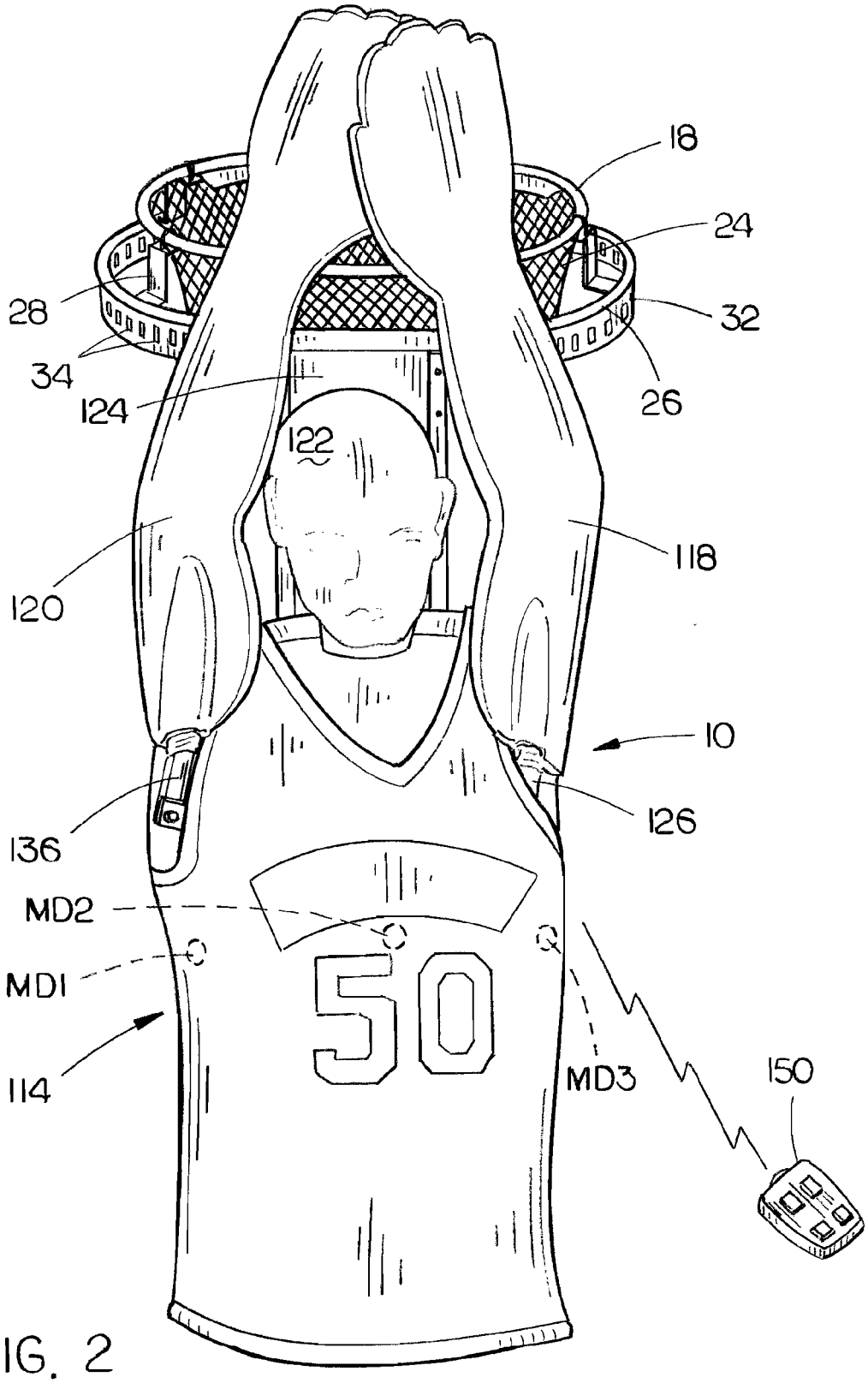
FIG. 2 is a front view of the basketball training device secured to the rim of a basketball goal with the movement of the simulated basketball player being controlled by a radio transmitter.

Assuming that the simulator player 114 is in the center facing position of FIGS. 1 and 2, if a player approaches the simulated player 114 from the right side thereof, motion detector MD1 will detect or sense such an approach, and communicate with control means CM which will activate motor 100 to rotate the simulated player 114 to the right so that the simulated player 114 faces the approaching player.

Assuming that the simulated player 114 is in the center facing positioning FIGS. 1 and 2, if a player approaches the simulated player 114 from the left side thereof, motion detector MD3 will detect or sense such an approach, and communicate with control means CM which will activate motor 100 to rotate the simulated player 114 to the left so that the simulated player faces the approaching player.

Assuming that the simulated player 114 is in the center facing position of FIGS. 1 and 2, if a player approaches the simulated player 114 from the front side thereof, motion detector MD2 will sense such an approach and communicate with control means CM. In this scenario, the motor 100 will not be activated so that the simulated player 114 remains in the center facing position.

In use, a coach or the like will use the transmitter 150 to cause motor 100 to move the simulated player 114 to a position between the player and the rim 18. The coach will also cause arms 118 and 120 of the simulated player 114 to be raised so that the player will have to shoot over the outstretched arms of the simulated player 114. When the arms of the simulated player are raised, the player seeking to rebound a basketball will have to reach over the outstretched arms of the simulated player 114. Thus, the player will have to dribble around the simulated player 114, shoot over the simulated arms of the simulated player 114, and rebound over the outstretched arms of the simulated player.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A basketball training device for use with a basketball goal including a backboard having a horizontally disposed rim secured thereto, comprising:

a horizontally disposed circular support positioned below the rim which is operatively secured to the backboard;

a horizontally disposed mounting structure selectively horizontally rotatably mounted on said circular support;

and a vertically disposed simulated basketball player secured to said mounting structure for movement therewith which extends downwardly therefrom.

2. The basketball training device of claim 1 wherein said simulated basketball player has a pair of selectively movable arms.

3. The basketball training device of claim 1 wherein said mounting structure includes a motor configured to rotate said mounting structure with respect to said circular support.

4. The basketball training device of claim 3 wherein said motor is remotely controlled.

5. The basketball training device of claim 4 wherein said motor is radio controlled.

6. The basketball training device of claim 3 wherein said circular support includes a gear rack and wherein said motor includes a driven shaft having a sprocket mounted therein which engages said gear rack.

7. The basketball training device of claim 1 wherein said circular support is secured to the rim.

8. The basketball training device of claim 2 wherein said movable arms are remotely controlled.

9. The basketball training device of claim 8 wherein a motor is operatively connected to each of said arms for selectively moving said arms.

10. The basketball training device of claim 3 further including motion detectors mounted on the simulated basketball player which detect the approach of a player to rotate the simulated basketball player to a position wherein the simulated player faces the approaching player.

11. A basketball training device for use with a basketball goal including a backboard having a horizontally disposed rim secured thereto, comprising:

a horizontally disposed circular support positioned below the rim which is operatively secured to the rim;

a horizontally disposed mounting structure selectively horizontally rotatably mounted on said circular support;

and a vertically disposed simulated basketball player secured to said mounting structure which extends downwardly therefrom.

12. The basketball training device of claim 11 wherein said simulated basketball player has a pair of selectively movable arms.

13. The basketball training device of claim 11 wherein said mounting structure includes a motor configured to rotate said mounting structure with respect to said circular support.

14. The basketball training device of claim 13 wherein said motor is remotely controlled.

15. The basketball training device of claim 14 wherein said motor is radio controlled.

16. The basketball training device of claim 13 wherein said circular support includes a gear rack and wherein said motor includes a driven shaft having a sprocket mounted therein which engages said gear rack.

17. The basketball training device of claim 12 wherein said movable arms are remotely controlled.

18. The basketball training device of claim 17 wherein a motor is operatively connected to each of said arms for selectively moving said arms.

19. The basketball training device of claim 13 further including motion detectors mounted on the simulated basketball player which detect the approach of a player to rotate the simulated basketball player to a position wherein the simulated player faces the approaching player.

* * * * *